US009566640B1

(12) United States Patent
Yuan

(10) Patent No.: US 9,566,640 B1
(45) Date of Patent: Feb. 14, 2017

(54) NUT RIVETER

(71) Applicant: Yuyao Tang Gong Stationery Co., Ltd., Yuyao, Zhejiang (CN)

(72) Inventor: Jianming Yuan, Zhejiang (CN)

(73) Assignee: Yuyao Tang Gong Stationery Co., Ltd. (CN)

( * ) Notice: Subject to any disclaimer, the term of this patent is extended or adjusted under 35 U.S.C. 154(b) by 0 days.

(21) Appl. No.: 15/043,582

(22) Filed: Feb. 14, 2016

(51) Int. Cl.
*B21J 15/38* (2006.01)
*B21J 15/04* (2006.01)
*B21J 15/36* (2006.01)

(52) U.S. Cl.
CPC ..... *B21J 15/383* (2013.01); *B21J 15/043* (2013.01); *B21J 15/045* (2013.01); *B21J 15/36* (2013.01); *B21J 15/386* (2013.01)

(58) Field of Classification Search
CPC ..... B21J 15/383; B21J 15/36; B21J 15/043; B21J 15/045; B21J 15/386; B25B 27/007; Y10T 29/53757
USPC ..... 29/243.527
See application file for complete search history.

(56) References Cited

U.S. PATENT DOCUMENTS 7,146,698 B2 * 12/2006 Kovar ..... B21J 15/36 29/243.527
9,003,621 B2 * 4/2015 Ko ..... B21J 15/386 29/243.521
9,162,278 B2 * 10/2015 Ko ..... B21J 15/383
2014/0345099 A1 * 11/2014 Ko ..... B21J 15/383 29/243.527

* cited by examiner

*Primary Examiner* — David B Jones

(57) ABSTRACT

The present invention discloses a nut riveter comprising a front riveter seat with a cavity, a rear riveter seat arranged in the cavity of the front riveter seat and located at a rear end of the front riveter seat, a nut adjusting mechanism arranged at a front end of the front riveter seat, a nut riveting rod installed in the nut adjusting mechanism, wherein two sides of the rear riveter seat are each connected to a handle through a connecting rod; a pull rod seat located in the cavity of the front riveter seat, wherein a pull rod is inserted into the pull rod seat, wherein a rear end of the pull rod is connected with a pull rod retractable mechanism.

18 Claims, 8 Drawing Sheets

NUT RIVETER

FIELD OF INVENTION

The present invention relates to the technical field of riveting tools, in particular to a nut riveter.

BACKGROUND OF THE INVENTION

A nut riveter is a tool used for riveting industrial nuts, can rivet nuts on plates and is widely used. For example, Chinese Patent No. 201010588266.4 discloses a nut riveter, which comprises a riveter seat, a nut adjusting mechanism arranged at a front end of the riveter seat, a nut riveting rod installed in the nut adjusting mechanism, two handles with front ends which are respectively hinged with the riveter seat through first pin shafts and fitting holes in two sides of the riveter seat, and a pull rod retractable mechanism connected to a pull rod, wherein the nut riveting rod is fixed at a front end of the pull rod; the nut riveter further comprises a screw rod with one end which is connected with the pull rod retractable mechanism through a sixth pin shaft and a screw rod outer sleeve with one end which is fixed on the pull rod retractable mechanism through threads, wherein the screw rod is arranged in a cavity of the screw rod outer sleeve; a push rod sleeves a position between the screw rod and the screw rod outer sleeve, steel balls fit with a screw groove in the screw rod are inlaid in one end of the push rod, a one-way clutch sleeves the other end of the push rod and the one-way clutch is fixed in a clutch seat; the clutch seat is connected with a withdrawing connecting rod through a fifth pin shaft and the withdrawing connecting rod is connected onto the handles through fourth pin shafts; the pull rod retractable mechanism comprises a pull rod seat, a fixed nut, second pin shafts, connecting rods and third pin shafts; the pull rod penetrates through the pull rod seat and a tail end of the pull rod is fixed on the fixed nut; the fixed nut is located in a chamber of the pull rod seat and a tail portion of the fixed nut is connected with the screw rod through the sixth pin shaft; and one end of the connecting rod is hinged with the front end of the handle through the second pin shaft and the other end of the connecting rod is connected with the pull rod through the third pin shaft.

The nut riveter in by the above-mentioned art provides improved nut riveting efficiency by riveting nuts based on the lever principle. However, the following problems often exist with conventional riveter: since the front ends of the handles are connected with the riveter seat through fastening pieces, the two handles must be pulled outwards first, and then inwards in order the grip the nut. The second pin shafts can be viewed as fulcrums of the lever principle. As the force in power arms are continuously reduced, the forced need in the resisting arms are continuously increased when the two handles are approaching each other. Consequently the force need to operate the riveter is gradually increased.

For smaller nuts, the force needed during riveting is smaller. The above-mentioned solution may be sufficient. However, for large nuts, more force is needed. In addition, when the two handles come closer to each other, the continuously increasing force may feel laborious and strenuous to its users. Particularly for people with less physical strength, the nut riveter may be hard to use. Therefore, a larger nut riveter is needed for large nuts. However, nuts of different sizes are often riveted within a short period of time during one particular operation. As a result, several nut riveters need to be carried and frequently changed during use and it is troublesome in use.

As a result, there is a need for a labor-efficient riveter that can accommodate nuts of different sizes.

SUMMARY OF THE INVENTION

In view of the above-mentioned defects in the prior art, the purpose of the present invention is to provide a nut riveter which is labor-saving and convenient to rivet nuts with different sizes.

According to the technical solution of the present invention, the nut riveter can comprise a front riveter seat with a cavity, a rear riveter seat arranged in the cavity of the front riveter seat and located at a rear end of the front riveter seat, a nut adjusting mechanism arranged at a front end of the front riveter seat and a nut riveting rod installed in the nut adjusting mechanism, wherein the two sides of the rear riveter seat are respectively connected with two handles through two connecting rods; and the nut riveter can further comprise a pull rod seat located in the cavity of the front riveter seat, wherein a pull rod is inserted into the pull rod seat, a rear end of the pull rod is connected with a pull rod retractable mechanism, the two ends of the pull rod seat are respectively connected with front ends of the two handles through first pin shafts, the front ends of the handles are further connected with front ends of the connecting rods through second pin shafts, and the rear ends of the connecting rods are connected with the rear riveter seat through third pin shafts.

Further, each of the two handles can be integrally formed by two connecting plates arranged in parallel, a connecting portion can be used for connecting the two connecting plates, a clamping groove for clamping the front end of the corresponding connecting rod is formed among the two connecting plates and the connecting portion, the two connecting plates thereon are provided with first shaft holes, the two sides of the pull rod seat are respectively provided with two convex plates, a holding groove for clamping the front end of the corresponding handle is formed between the two convex plates, the convex plates thereon are provided with first positioning holes, and the first pin shafts penetrate through the first positioning holes and the first shaft holes to couple the front ends of the handles with the pull rod seat.

Further, front ends of the two connecting plates of each handle are provided with side plates formed by inward extension, the side plates thereon are provided with second shaft holes for clamping the second pin shafts, the front ends and the rear ends of the connecting rods are respectively provided with second positioning holes and third positioning holes, and the second pin shafts penetrate through the second positioning holes and the second shaft holes to couple with the front ends of the connecting rods with the front ends of the handles; a front end of the rear riveter seat is provided with insertion grooves for inserting the rear ends of the connecting rods, the rear riveter seat thereon is provided with third shaft holes matched with the third positioning holes, and the third pin shafts penetrate through the third shaft holes and the third positioning holes and hinge the rear ends of the connecting rods with the rear riveter seat.

Further, the nut adjusting mechanism can comprise a sliding sleeve which covers the front end of the pull rod and is in sliding fit with the pull rod, a sleeve which is arranged at the front end of the front riveter seat, a nut which is arranged on a front end of the sleeve and sleeves the nut riveting rod, and a spring which is located below the sliding sleeve and sleeves the pull rod.

Further, a rear end of the nut riveting rod can be provided with male threads and the male threads fits with female threads at the front end of the pull rod; the front end of the front riveter seat is in thread fit with the rear end of the sleeve, the sleeve covers the sliding sleeve and the front end of the sleeve is in thread fit with the rear end of the nut; and the spring is located between the sliding sleeve and the pull rod seat, i.e., a top end of the spring resists against a rear end of the sliding sleeve and a bottom end of the spring resists against the front end of the pull rod seat.

Further, an external portion of the rear end of the nut riveting rod can be a polygon; an external portion of the front end of the pull rod is a polygon as the same as the polygon of the rear end of the nut riveting rod; and an inner hole provided in the sliding sleeve is a polygon fit with the polygon of the front end of the pull rod.

Further, the polygon can be a regular hexagon.

Further, the pull rod retractable mechanism can comprise a fixed nut which is arranged at the rear end of the pull rod, a screw rod which is arranged at the rear end of the fixed nut through one first pin rod, a drawing rod which sleeves the screw rod, a sleeve rod which sleeves the drawing rod, an adjustable nut which is arranged at a rear end of the sleeve rod in a thread connection manner, and a knob which is arranged at a rear end of the drawing rod through one second pin rod.

Further, the rear end of the pull rod is in thread fit with a front end of the fixed nut, and a front end of the sleeve rod is in thread fit with an inner wall of the pull rod seat; and a front end of the drawing rod is provided with steel balls, and the steel balls are inlaid in a screw groove provided in the screw rod.

Further, the handles thereon can be provided with handle sleeves.

The nut riveter provided by the present invention has the advantage of, gradually reducing the pressure applied by hands when the handles are being pulled together thus achieving labor efficiency by accommodating rivet nuts of different sizes.

Figure 1:
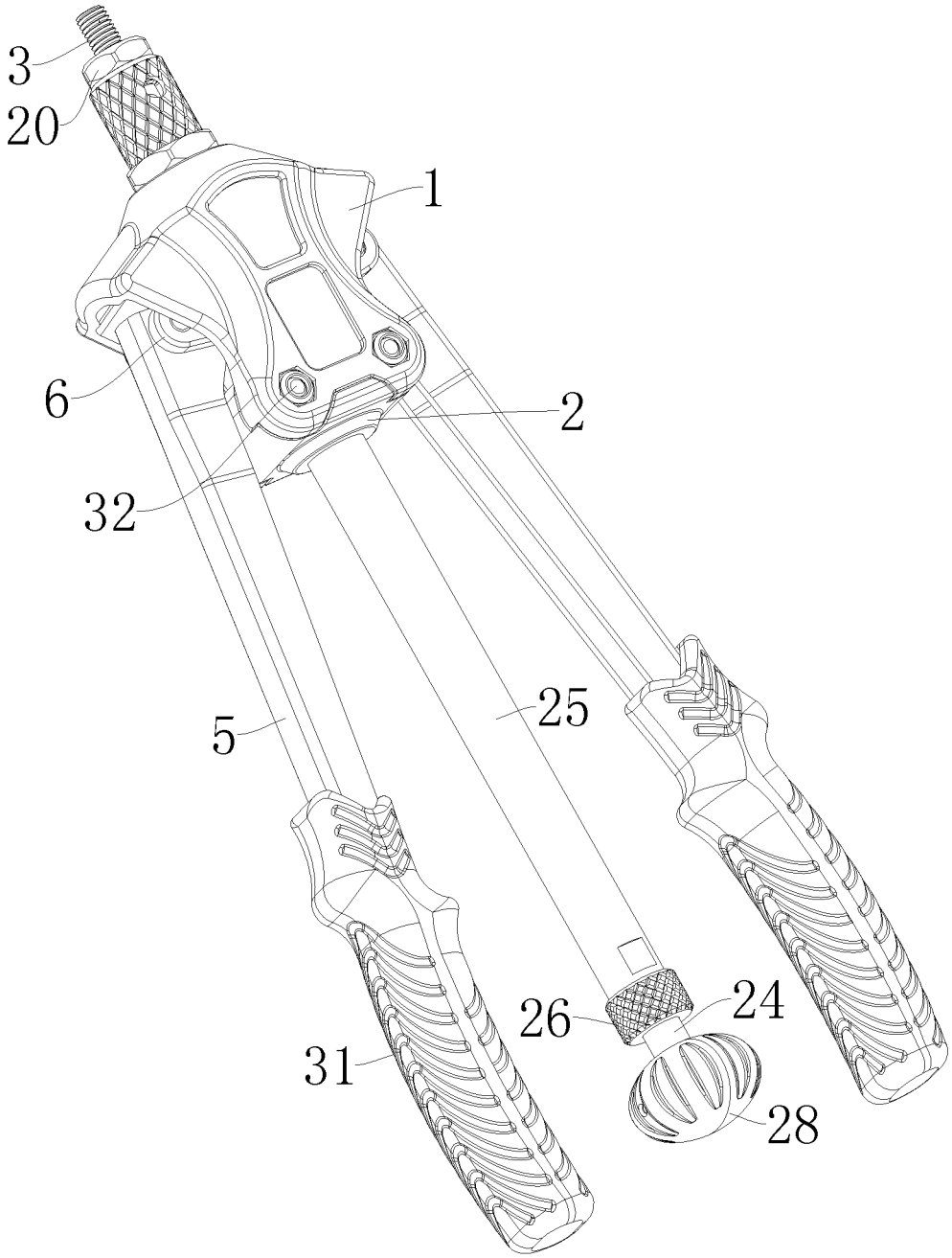
FIG. 1 is a schematic diagram of an overall structure of the present invention.
Figure 2:
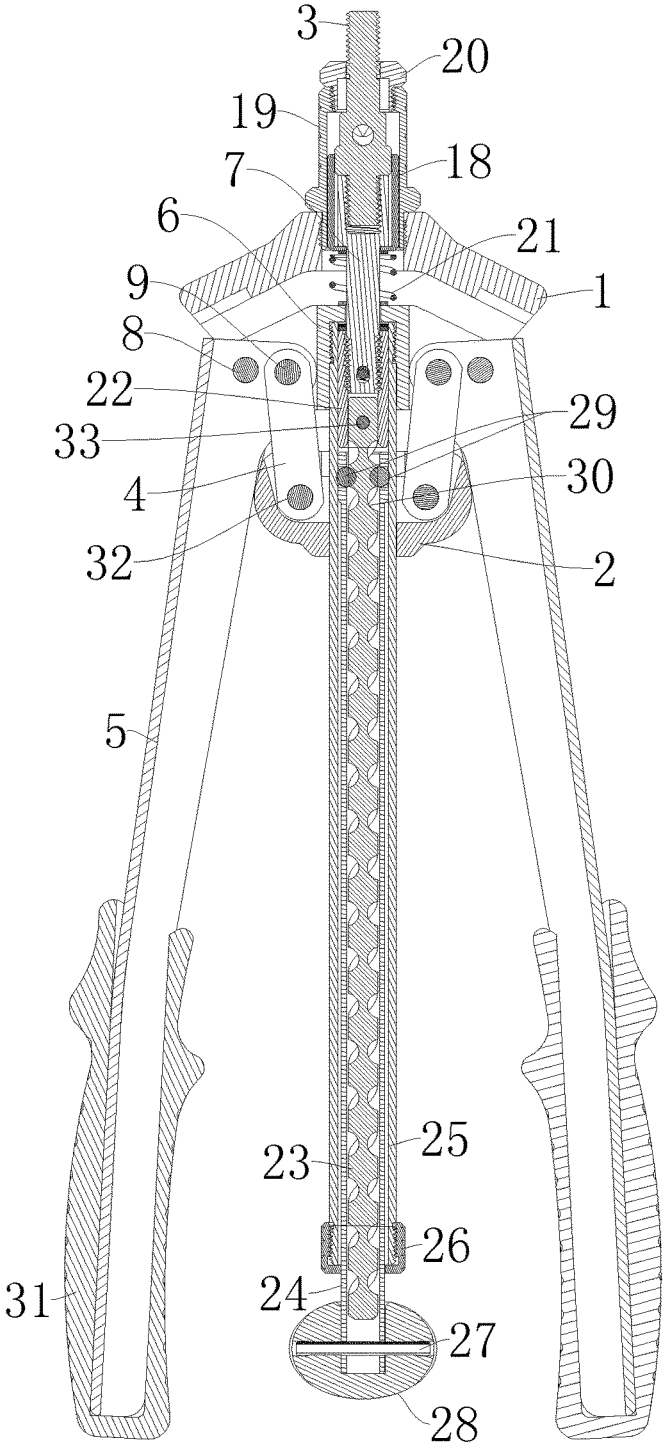
FIG. 2 is a schematic diagram of a sectional structure of the present invention.
Figure 3:
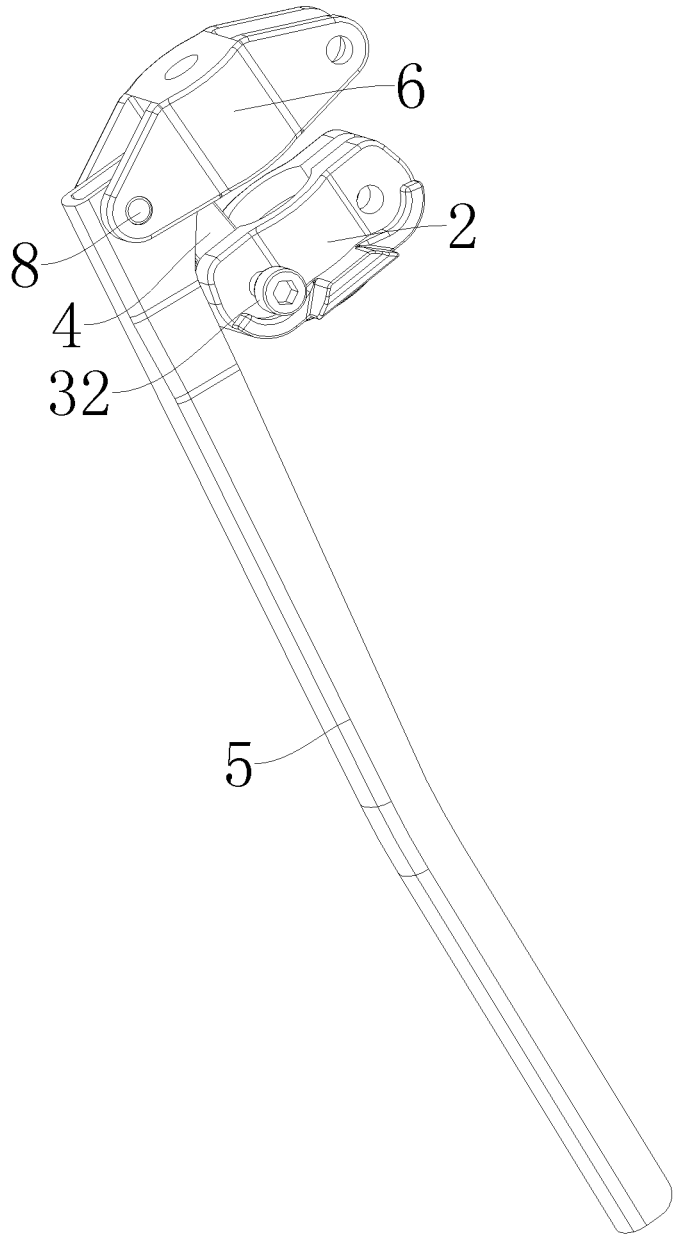
FIG. 3 is a schematic diagram of a structure of the present invention after handles are connected with a pull rod seat and a rear riveter seat.
Figure 4:
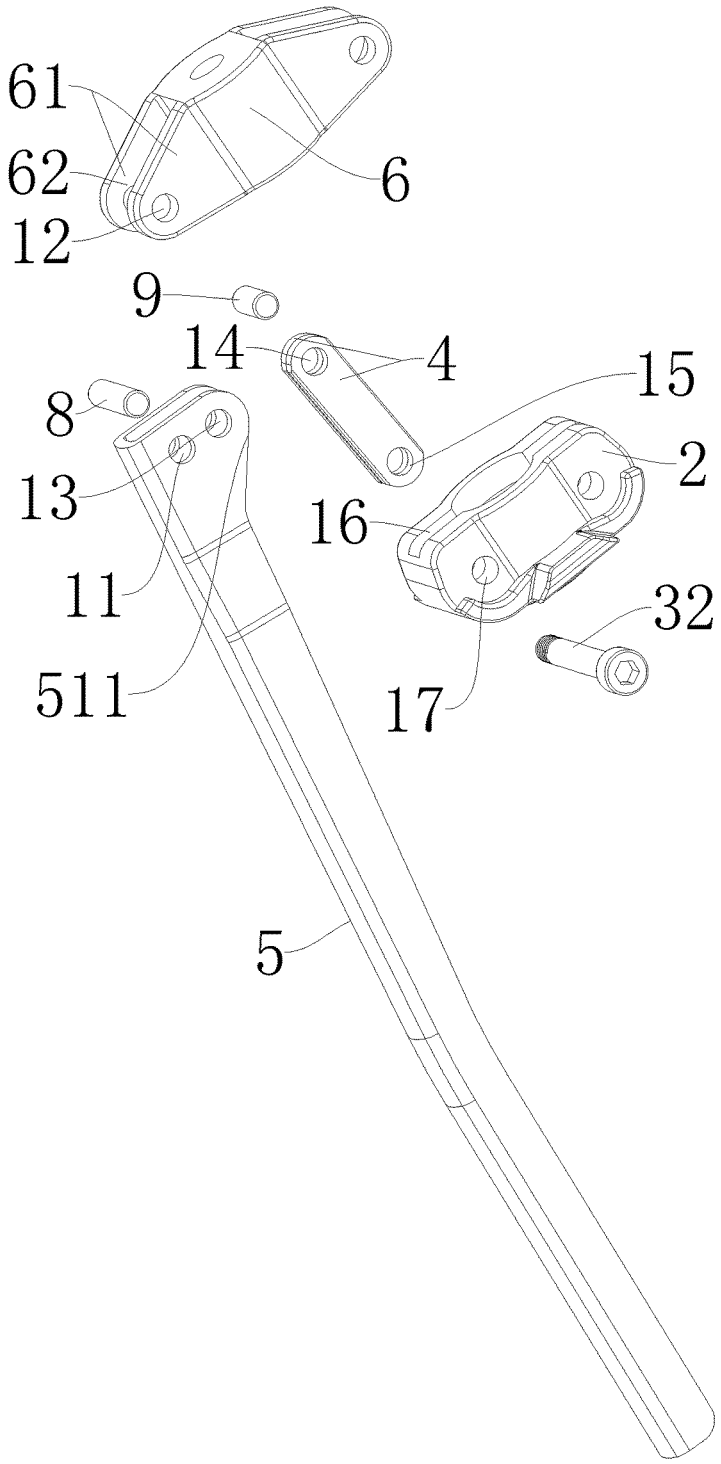
FIG. 4 is an exploded schematic diagram of the present invention before handles are connected with a pull rod seat and a rear riveter seat.
Figure 5:
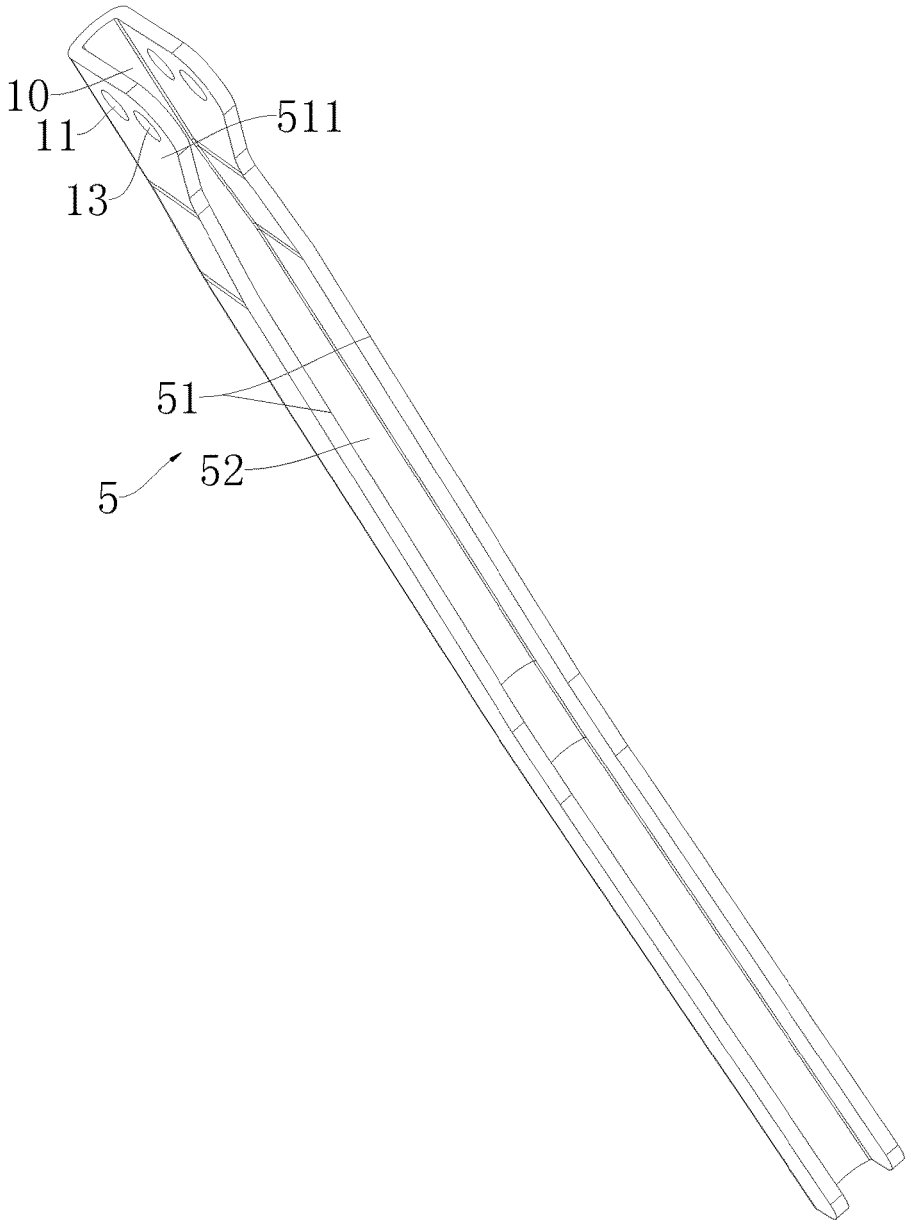
FIG. 5 is a schematic diagram of a structure of handles of the present invention.

As shown in the drawings: 1-front riveter seat, 2-rear riveter seat, 3-nut riveting rod, 4-connecting rod, 5-handle, 51-connecting plate, 511-side plate, 52-connecting portion, 6-pull rod seat, 61-convex plate, 62-holding groove, 7-pull rod, 8-first pin shaft, 9-second pin shaft, 10-clamping groove, 11-first shaft hole, 12-first positioning hole, 13-second shaft hole, 14-second positioning hole, 15-third positioning hole, 16-insertion groove, 17-third shaft hole, 18-sliding sleeve, 19-sleeve, 20-nut, 21-spring, 22-fixed nut, 23-screw rod, 24-drawing rod, 25-sleeve rod, 26-adjustable nut, 27-second pin rod, 28-knob, 29-steel ball, 30-screw groove, 31-handle sleeve, 32-third pin shaft, and 33-first pin rod.

DETAILED DESCRIPTION

The present invention will be described below in detail in reference to the figures and the embodiments. It should be understood that the embodiments described herein are only used for the purpose of explaining the present invention and shall not be viewed as basis for limiting the scope of the present invention.

As shown in FIGS. 1-5, an embodiment of a nut riveter can comprise a front riveter seat 1 with a cavity, a rear riveter seat 2 arranged in the cavity of the front riveter seat 1 and located at a rear end of the front riveter seat 1, a nut adjusting mechanism arranged at a front end of the front riveter seat 1 and a nut riveting rod 3 installed in the nut adjusting mechanism, wherein two sides of the rear riveter seat 2 each is connected to a handle 5 through a connecting rods 4; and the nut riveter further comprises a pull rod seat 6 located in the cavity of the front riveter seat 1, wherein a pull rod 7 is inserted into the pull rod seat 6, a rear end of the pull rod 7 is connected with a pull rod retractable mechanism, two ends of the pull rod seat 6 are respectively connected with front ends of the two handles 5 through first pin shafts 8, the front ends of the handles 5 are further connected with front ends of the connecting rods 4 through second pin shafts 9, rear ends of the connecting rods 4 are connected with the rear riveter seat 2 through third pin shafts 32, and the rear riveter seat 2 is also connected with the rear end of the front riveter seat 1 through the third pin shafts 32.

Each of the two handles 5 is integrally formed by two connecting plates 51 arranged in parallel, a connecting portion 52 used for connecting the two connecting plates 51, a clamping groove 10 for clamping the front end of the corresponding connecting rod 4 is formed among the two connecting plates 51 and the connecting portion 52, the two connecting plates 51 thereon are provided with first shaft holes 11, the two sides of the pull rod seat 6 are respectively provided with two convex plates 61, a holding groove 62 for clamping the front end of the corresponding handle 5 is formed between the two convex plates 61, the convex plates 61 thereon are provided with first positioning holes 12, and the first pin shafts 8 penetrate through the first positioning holes 12 and the first shaft holes 11 and hinge together the front ends of the handles 5 with the pull rod seat 6. The front ends of the two connecting plates 51 of each handle 5 are provided with side plates 511 formed by inward extension, the side plates 511 thereon are provided with second shaft holes 13 for clamping the second pin shafts 9, the front ends and the rear ends of the connecting rods 4 are respectively provided with second positioning holes 14 and third positioning holes 15, and the second pin shafts 9 penetrate through the second positioning holes 14 and the second shaft holes 13 to hinge the front ends of the connecting rods 4 with the front ends of the handles 5 together; a front end of the rear riveter seat 2 is provided with insertion grooves 16 for inserting the rear ends of the connecting rods 4, the rear riveter seat 2 thereon is provided with third shaft holes 17 matched with the third positioning holes 15, and the third pin shafts 32 penetrate through the third shaft holes 17 and the third positioning holes 15 to hinge together the rear ends of the connecting rods 4 with the rear riveter seat 2.

The nut adjusting mechanism comprises a sliding sleeve 18 which covers the front end of the pull rod 7 and is in sliding fit with the pull rod 7, a sleeve 19 which is arranged at the front end of the front riveter seat 1, a nut 20 which is arranged on a front end of the sleeve 19 and sleeves the nut riveting rod 3, and a spring 21 which is located below the sliding sleeve 18 and sleeves the pull rod 7. A rear end of the nut riveting rod 3 is provided with male threads and the male threads are fit with female threads at the front end of the pull rod 7; the front end of the front riveter seat 1 is in thread fit with the rear end of the sleeve 19, the sleeve 19 covers the sliding sleeve 18 and the front end of the sleeve 19 is in thread fit with the rear end of the nut 20; and the spring 21 is located between the sliding sleeve 18 and the pull rod seat 6, i.e., a top end of the spring 21 resists against a rear end of the sliding sleeve 18 and a bottom end of the spring 21 resists against the front end of the pull rod seat 6. An external portion of the rear end of the nut riveting rod 3 is a polygon; an external portion of the front end of the pull rod 7 is a polygon as the same as the polygon of the rear end of the nut riveting rod 3; and an inner hole provided in the sliding sleeve 18 is a polygon fit with the polygon of the front end of the pull rod 7. During operation, the sliding sleeve 18 is pulled down by using hands, the nut riveting rod 3 and the pull rod 7 are screwed together by using hands, and the sliding sleeve 18 is consequently loosened to enable the sliding sleeve 18 to cover the pull rod 7 and the nut riveting rod 3 together. The nut riveting rod 3 and the pull rod 7 are in thread connection to guarantee the tensile strength, and simultaneously the polygon of the pull rod 7 and the polygon of the nut riveting rod 3 are sleeved together through the polygon of the sliding sleeve 18 to guarantee that the nut riveting rod 3 and the pull rod 7 are not loosened during working. As a preferred embodiment of the present invention, the polygon is a regular hexagon.

The pull rod retractable mechanism comprises a fixed nut 22 which is arranged at the rear end of the pull rod 7, a screw rod 23 which is arranged at the rear end of the fixed nut 22 through one first pin rod 33, a drawing rod 24 which sleeves the screw rod 23, a sleeve rod 25 which sleeves the drawing rod 24, an adjustable nut 26 which is arranged at a rear end of the sleeve rod 25 in a thread connection manner, and a knob 28 which is arranged at a rear end of the drawing rod 24 through one second pin rod 27. The rear end of the pull rod 7 is in thread fit with a front end of the fixed nut 22, and a front end of the sleeve rod 25 is in thread fit with an inner wall of the pull rod seat 6; and a front end of the drawing rod 24 is provided with steel balls 29, and the steel balls 29 are inlaid in a screw groove 30 provided in the screw rod 23.

The handles 5 thereon are provided with handle sleeves 31, which can play roles of preventing slippery and protecting the hands.

When the nut riveter provided by the present invention is used for riveting nuts, firstly two hands are used to hold the two handles 5 to open the two handles 5, a nut to be processed is installed on the nut riveting rod, then a force is applied to close the two handles 5, the pull rod 7 moves rearwards under the effect of the pull rod retractable mechanism during closing and thereby the nut is riveted on a workpiece; and after the riveting is completed, the two handles 5 are opened again, then the knob 28 is pulled, the steel balls 29 at the front end of the drawing rod 24 move in the screw groove of the screw rod 23 through the arrangement of the sleeve rod 25 and the drawing rod 24, the screw rod 23 drives the pull rod 7 to rotate together, the pull rod 7 drives the nut riveting rod 3 to rotate together and the nut riveting rod 3 is withdrawn from the riveted nut. Of course, the above-mentioned nut riveting manner is just a preferred embodiment of the present invention. During actual design, the structure of the pull rod retractable mechanism can also be changed to a simpler form, i.e., the length of the screw rod 23 is shortened, the drawing rod 24 and the sleeve rod 25 are not arranged, the nut riveting rod 3 is taken down from the riveted nut in a manner of rotating the knob 28 after the riveting is completed, the structure is simple and the use cost is low. However, it is troublesome to use the pull rod retractable mechanism designed in the structure, the knob 28 needs to be uninterruptedly rotated and considerable time is consumed; and however, although the structure of the pull rod retractable mechanism provided by the present invention is complex, the pull rod retractable mechanism is convenient to use and the nut riveting rod 3 can be more quickly taken down from the riveted nut. Therefore, during actual use, the structure of the pull rod retractable mechanism can be selected according to different use demands.

In addition, the nut riveting rod 3 in the present invention is convenient to be replaced. During replacement, the sliding sleeve 18 is pulled rearwards to enable the polygon portion of the rear end of the nut riveting rod 3 to be separated from the inner hole of the sliding sleeve 18, the spring is compressed at this moment, then the nut riveting rod 3 is screwed out from the front end of the pull rod 7, a new nut riveting rod 3 is fixed to the front end of the pull rod 7 through threads, finally the sliding sleeve 18 is released, the sliding sleeve 18 restores to an original position under the effect of the elastic force of the spring 21, and thereby the sliding sleeve 18 sleeves the pull rod 7 and the new nut riveting rod 3 together to complete the replacement of the nut riveting rod 3.

Figure 6:
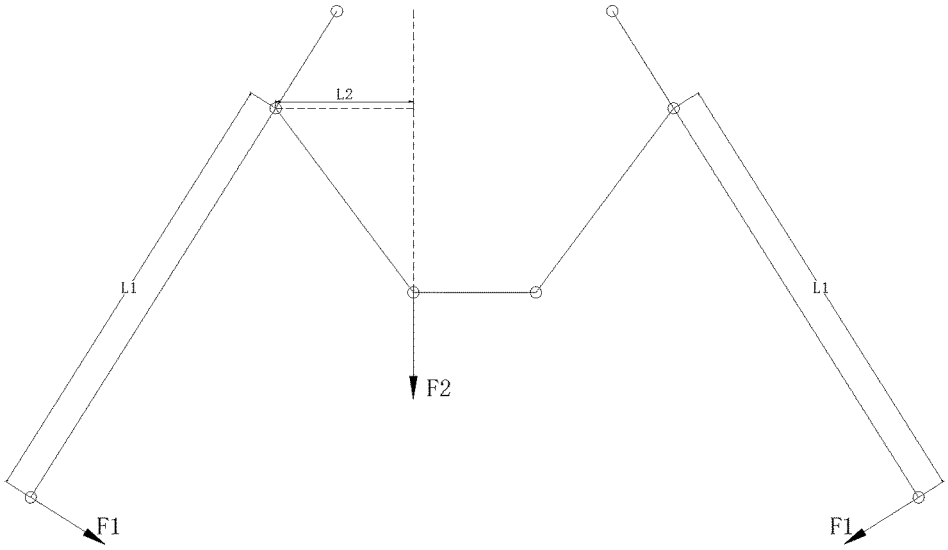
FIG. 6 is a schematic diagram of stress force when handles and connecting rods of a nut riveter of the prior art are in an opened state.
Figure 7:
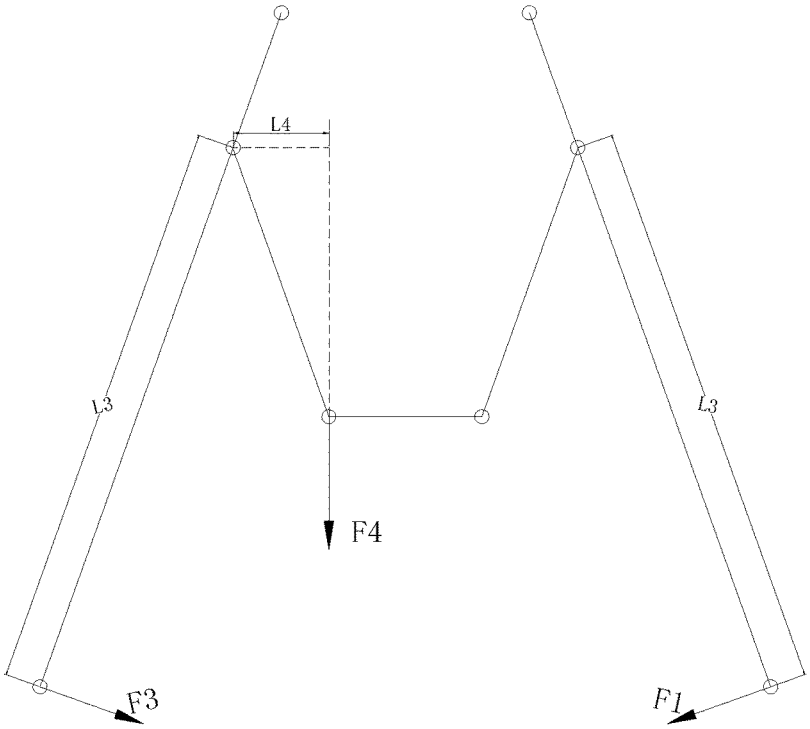
FIG. 7 is a schematic diagram of stress force when handles and connecting rods of a nut riveter of the prior art are closed.
Figure 8:
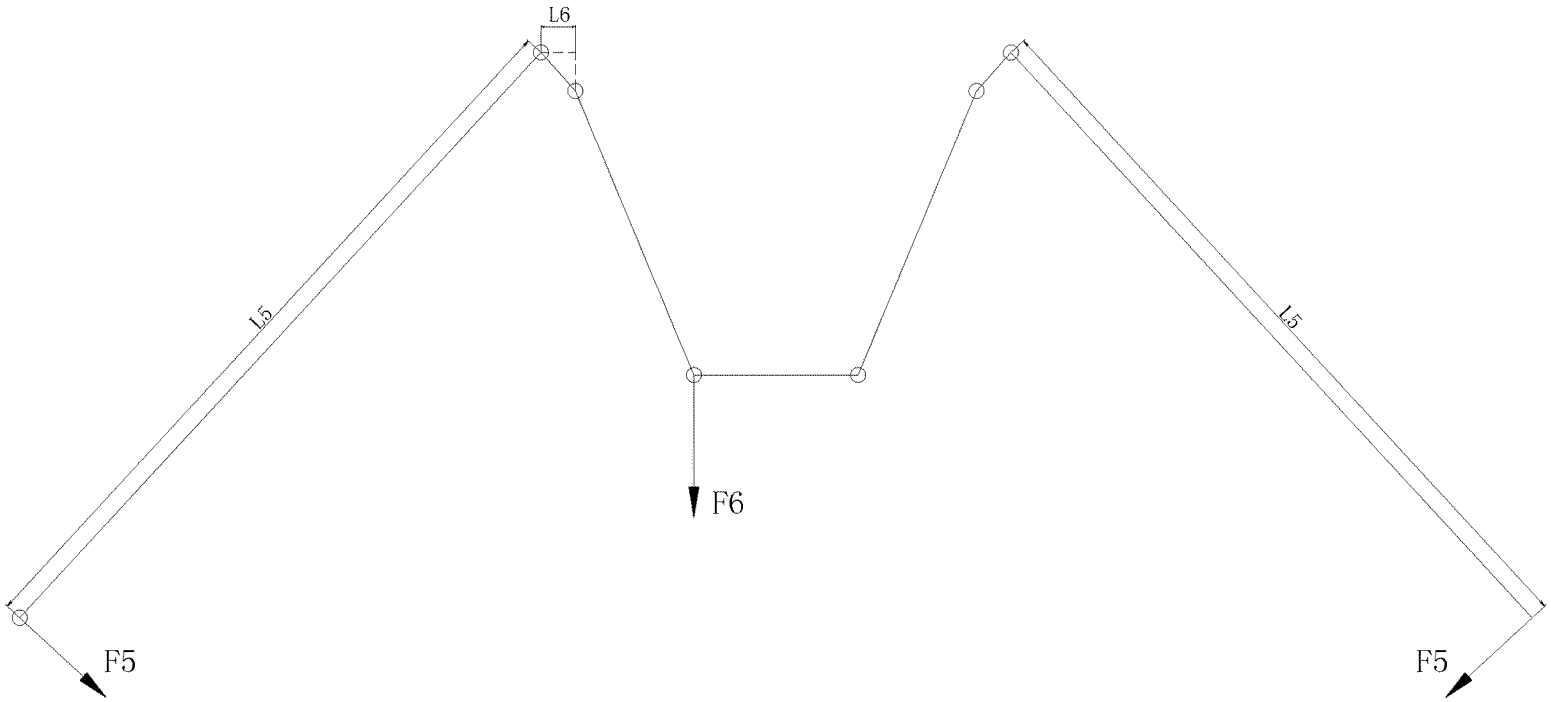
FIG. 8 is a schematic diagram of stress force when handles and connecting rods of a nut riveter of the present invention are in an opened state.
Figure 9:
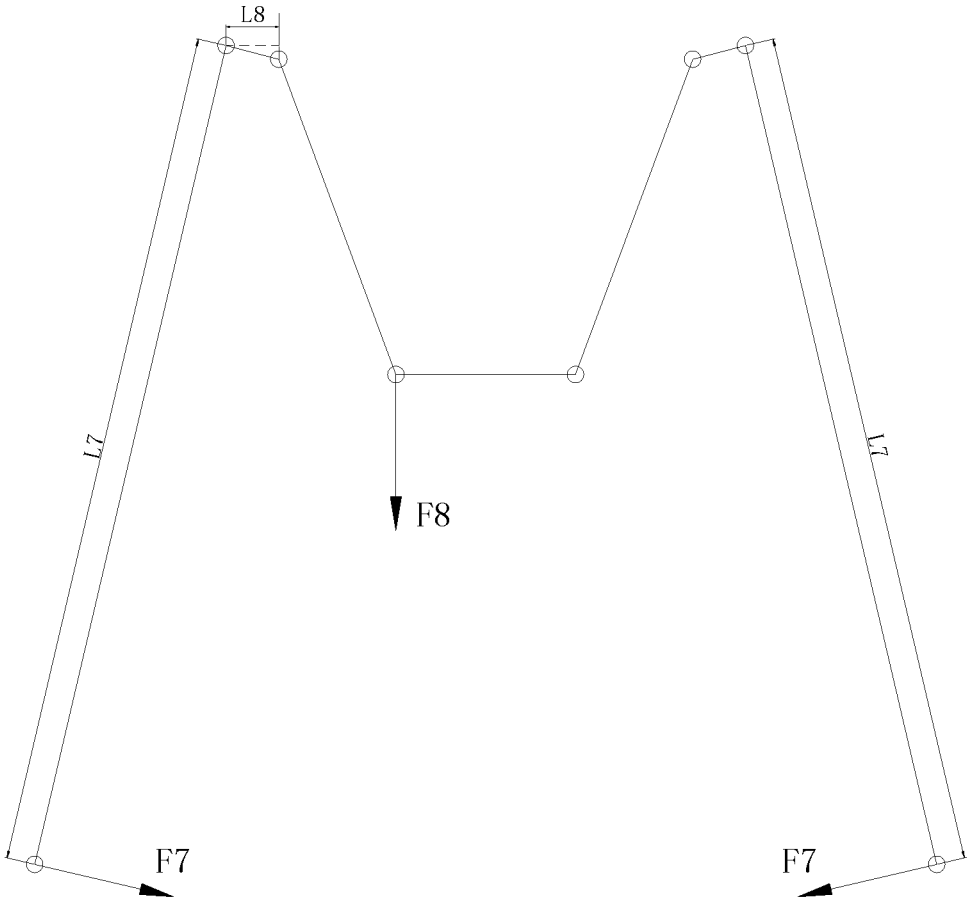
FIG. 9 is a schematic diagram of stress force when handles and connecting rods of a nut riveter of the present invention are closed.

As shown in FIGS. 6 and 7, in the prior art, L1 are power arms when the handles are opened, L2 are resisting arms when the handles are opened, L3 are power arms when the handles are closed, L4 are resisting arms when the handles are closed, F1 and F3 are power, F2 and F4 are resistance, F1*L1=F2*L2, F3*L3=F4*L4, the power arms are kept unchanged when the nut riveter moves from a state as shown in FIG. 6 to a state as shown in FIG. 7, i.e., F2=F4 and the power is gradually increased, i.e., F1<F3; and as shown in FIGS. 8 and 9, in the present invention, L5 are power arms when the handles 5 are opened, L6 are resisting arms when the handles 5 are opened, L6 are power arms when the handles 5 are closed, L6 are resisting arms when the handles are closed, F5 and F6 are power, F7 and F8 are resistance, F5*L5=F6*L6, F7*L7=F8*L8, the power arms are kept unchanged when the nut riveter moves from a state as shown in FIG. 8 to a state as shown in FIG. 9, i.e., L5=L7, the resisting arms are gradually increased, and the power is gradually decreased, i.e., F5>F7, in order to keep the resistance unchanged, i.e., F6=F8. In addition, since the handles of the nut riveter in the prior art are connected with the front riveter seat, due to the limitation of the structure, the handles cannot move forwards or rearwards even though the front ends of the handles can rotate through the pin shafts, and thereby the resisting arms are larger at the begging of the riveting of the nut during use after the handles are connected with the connecting rods; and however, the handles 5 of the present invention are not connected with the front riveter seat, the handles 5 work independent of the front riveter seat, the handles 5 and the pull rod seat 6 simultaneously move towards the front portion of the front riveter seat 1 when the handles 5 are opened, the handles 5 and the pull rod seat 6 simultaneously move towards the rear portion of the front riveter seat 1 when the handles 5 are closed, the handles 5 and the connecting rods 4 can move freely, the resisting arms can be set to a smaller extent after the handles 5 are connected with the connecting rods 4, thereby the resisting arms at the beginning of the riveting of the nut are smaller and it is more labor-saving in use.

According to the nut riveter provided by the present invention, the pull rod 7 is inserted into the pull rod seat 6, the rear end of the pull rod 7 is connected with the pull rod retractable mechanism, the two ends of the pull rod seat 6 are respectively connected with the front ends of the two handles 5 through the first pin shafts 8, the front ends of the handles 5 are further connected with the front ends of the connecting rods 4 through the second pin shafts 9, the rear ends of the connecting rods 4 are connected with the rear riveter seat 2 through the third pin shafts 32, the handles 5 are not connected with the front riveter seat 1, i.e., the handles 5 work independent of the front riveter seat 1, the pressure applied by the hands is gradually reduced when the handles 5 are closed, and the nut riveter can be labor-saving during use and can rivet nuts with different sizes.

Of course, the above-mentioned embodiments are just preferred embodiments of the present invention, and do not limit the patent range of the present invention thereby. All simple modifications and equivalent structural changes made by using the contents of the description and the drawings of the present invention shall also be included in the patent protection range of the present invention.

What is claimed is:

1. A nut riveter comprising:

a front riveter seat with a cavity, a rear riveter seat having two sides, arranged in the cavity of the front riveter seat and located at a rear end of the front riveter seat, a nut adjusting mechanism arranged at a front end of the front riveter seat, a nut riveting rod installed in the nut adjusting mechanism, two handles each having a front end, two connecting rods each having a front end and a rear end, a pull rod having a rear end, a pull rod retractable mechanism, a pull rod seat having two ends, located in the cavity of the front riveter seat, two first pin shafts, two second pin shafts, two third pin shafts, wherein the two sides of the rear riveter seat are each connected to a handle through a connecting rod; wherein the pull rod is inserted into the pull rod seat, wherein the rear end of the pull rod is connected with the pull rod retractable mechanism, wherein the two ends of the pull rod seat are respectively connected with the front ends of the two handles through the first pin shafts, wherein the front ends of the handles are further connected with front ends of the connecting rods through the second pin shafts, and wherein rear ends of the connecting rods are connected with the rear riveter seat through the third pin shafts.

2. The nut riveter according to claim 1, wherein each of the two handles is integrally formed by two connecting plates arranged in parallel, wherein a connecting portion used for connecting the two connecting plates, wherein a clamping groove for clamping the front end of the corresponding connecting rod is formed between the two connecting plates and the connecting portion, wherein the two connecting plates thereon are provided with first shaft holes, wherein the two sides of the pull rod seat are respectively provided with two convex plates, wherein a holding groove for clamping the front end of the corresponding handle is formed between the two convex plates, wherein the convex plates thereon are provided with first positioning holes, and wherein the first pin shafts penetrate through the first positioning holes and the first shaft holes to couple the front ends of the handles with the pull rod seat.

3. The nut riveter according to claim 2, wherein front ends of the two connecting plates of each handle are provided with side plates formed by an inward extension, wherein the side plates thereon are provided with second shaft holes for clamping the second pin shafts, wherein the front ends and the rear ends of the connecting rods are respectively provided with second positioning holes and third positioning holes, wherein the second pin shafts penetrate through the second positioning holes and the second shaft holes to couple the front ends of the connecting rods with the front ends of the handles; wherein a front end of the rear riveter seat is provided with insertion grooves for inserting the rear ends of the connecting rods, wherein the rear riveter seat thereon is provided with third shaft holes matched with the third positioning holes, and wherein the third pin shafts penetrate through the third shaft holes and the third positioning holes to couple the rear ends of the connecting rods with the rear riveter seat.

4. The nut riveter according to claim 1, wherein the nut adjusting mechanism further comprising a sliding sleeve covering the front end of the pull rod, a sleeve arranged at the front end of the front riveter seat, a nut which is arranged on a front end of the sleeve covering the nut riveting rod, and a spring disposed below the sliding sleeve and sleeves the pull rod.

5. The nut riveter according to claim 4, wherein a rear end of the nut riveting rod is provided with male threads and the male threads are fit with female threads at the front end of the pull rod; wherein the front end of the front riveter seat is in thread fit with the rear end of the sleeve, wherein the sleeve covers the sliding sleeve, wherein the front end of the sleeve is in thread fit with the rear end of the nut; and wherein the spring is located between the sliding sleeve and the pull rod seat.

6. The nut riveter according to claim 5, wherein an external portion of the rear end of the nut riveting rod is a polygon; wherein an external portion of the front end of the pull rod is a polygon as the same as the polygon of the rear end of the nut riveting rod; and wherein an inner hole provided in the sliding sleeve is a polygon fit with the polygon of the front end of the pull rod.

7. The nut riveter according to claim 6, wherein the polygon is a regular hexagon.

8. The nut riveter according to claim 1, wherein the pull rod retractable mechanism further comprising a fixed nut arranged at the rear end of the pull rod, a screw rod arranged at the rear end of the fixed nut through one first pin rod, a drawing rod covering the screw rod, a sleeve rod covering the drawing rod, an adjustable nut arranged at a rear end of the sleeve rod in a thread connection manner, and a knob arranged at a rear end of the drawing rod through one second pin rod.

9. The nut riveter according to claim 8, wherein the rear end of the pull rod is in thread fit with a front end of the fixed nut, wherein a front end of the sleeve rod is in thread fit with an inner wall of the pull rod seat; wherein the front end of the drawing rod is provided with steel balls, and wherein the steel balls are inlaid in a screw groove provided in the screw rod.

10. The nut riveter according to claim 1, wherein the handles thereon are provided with handle sleeves.

11. The nut riveter according to claim 2, wherein the handles thereon are provided with handle sleeves.

12. The nut riveter according to claim 3, wherein the handles thereon are provided with handle sleeves.

13. The nut riveter according to claim 4, wherein the handles thereon are provided with handle sleeves.

14. The nut riveter according to claim 5, wherein the handles thereon are provided with handle sleeves.

15. The nut riveter according to claim 6, wherein the handles thereon are provided with handle sleeves.

16. The nut riveter according to claim 7, wherein the handles thereon are provided with handle sleeves.

17. The nut riveter according to claim 8, wherein the handles thereon are provided with handle sleeves.

18. The nut riveter according to claim 9, wherein the handles thereon are provided with handle sleeves.

* * * * *